US007028920B2

(12) United States Patent
Hekman et al.

(10) Patent No.: US 7,028,920 B2
(45) Date of Patent: Apr. 18, 2006

(54) ADJUSTABLE ARC SPRINKLER WITH FULL CIRCLE OPERATION

(75) Inventors: Matthew R. Hekman, Redlands, CA (US); Greg N. Shaw, Moreno Valley, CA (US)

(73) Assignee: The Toro Company, Bloomington, MN (US)

( * ) Notice: Subject to any disclaimer, the term of this patent is extended or adjusted under 35 U.S.C. 154(b) by 79 days.

(21) Appl. No.: 10/797,436

(22) Filed: Mar. 10, 2004

(65) Prior Publication Data

US 2005/0199749 A1 Sep. 15, 2005

(51) Int. Cl.

| | |
|---|---|
| ***B05B 3/04*** | (2006.01) |
| ***B05B 3/10*** | (2006.01) |
| ***B05B 15/10*** | (2006.01) |
| ***B05B 3/00*** | (2006.01) |

(52) U.S. Cl. ..... 239/240; 239/242; 239/204; 239/206

(58) Field of Classification Search ..... 239/240, 239/242, 204, 206, 200–201, 203, 205, 225.1, 239/237, 255

See application file for complete search history.

(56) References Cited

U.S. PATENT DOCUMENTS

| | | | |
|---|---|---|---|
| 4,417,691 | A | 11/1983 | Lockwood |
| 4,624,412 | A | 11/1986 | Hunter |
| 4,625,914 | A | 12/1986 | Sexton et al. |
| 4,634,052 | A | 1/1987 | Grizzle et al. |
| RE32,386 | E | 3/1987 | Hunter |
| 4,892,252 | A | 1/1990 | Bruninga |
| 4,925,098 | A | 5/1990 | Di Paola |

(Continued)

FOREIGN PATENT DOCUMENTS

WO WO 03/020432 A1 3/2003

OTHER PUBLICATIONS

Matt Heckman, *Recreation of Toro 2001 Series Rotor,* Oct. 28, 2005, 1 page.

(Continued)

*Primary Examiner*—David A. Scherbel
*Assistant Examiner*—Darren Gorman
(74) *Attorney, Agent, or Firm*—Inskeep IP Group, Inc.

(57) ABSTRACT

The present invention provides a sprinkler with both a reversing part-circle mode and a non-reversing full-circle mode. More specifically, the present invention provides a mechanism for disengaging sprinkler arc stops, allowing for a full circle, non-reversing watering pattern.

13 Claims, 10 Drawing Sheets

U.S. PATENT DOCUMENTS

| | | | | |
|---|---|---|---|---|
| 5,098,021 | A * | 3/1992 | Kah, Jr. | 239/242 |
| 5,174,501 | A | 12/1992 | Hadar | |
| 5,330,103 | A | 7/1994 | Eckstein | |
| 5,368,229 | A | 11/1994 | Hayes et al. | |
| 5,375,768 | A | 12/1994 | Clark | |
| 5,762,270 | A | 6/1998 | Kearby et al. | |
| 6,042,021 | A | 3/2000 | Clark | |
| 6,085,995 | A | 7/2000 | Kah, Jr. et al. | |
| 6,109,545 | A * | 8/2000 | Kah, Jr. | 239/242 |
| 6,182,909 | B1 | 2/2001 | Kah, Jr. et al. | |
| 2002/0092924 | A1 | 7/2002 | Ingham, Jr. et al. | |
| 2002/0153432 | A1 | 10/2002 | McKenzie et al. | |

OTHER PUBLICATIONS

Toro Irrigation Division, *Arm, Clutch,* Feb. 14, 1994, 1 page, Toro Irrigation Division, Riverside, California.

Toro Irrigation Division, *Shaft,* Nov. 23, 1993, 1 page, Toro Irrigation Division, Riverside, California.

Toro Irrigation Division, *Arm, Adjusting,* Nov. 25, 1997, 1 page, Toro Irrigation Division, Riverside, California.

Toro Irrigation Division, *Base, Nozzle,* Sep. 28, 2000, 1 page, Toro Irrigation Division, Riverside, California.

Toro Irrigation Division, *Nozzle Top, 0-360,* Jun. 17, 1994, 1 page, Toro Irrigation Division, Riverside, California.

* cited by examiner

FIG. 6
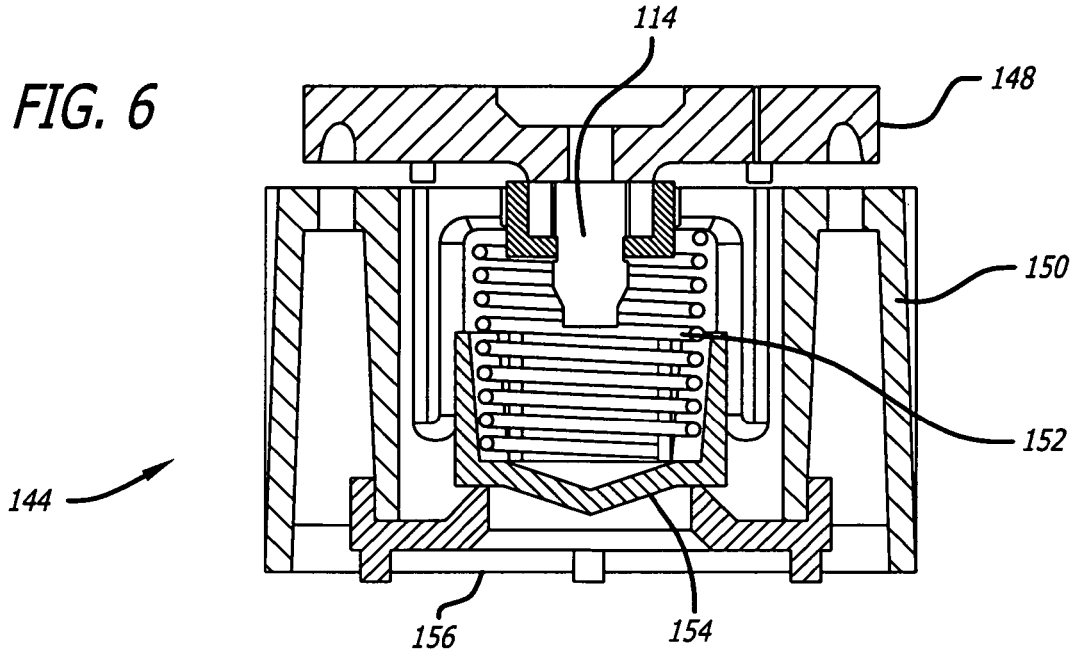
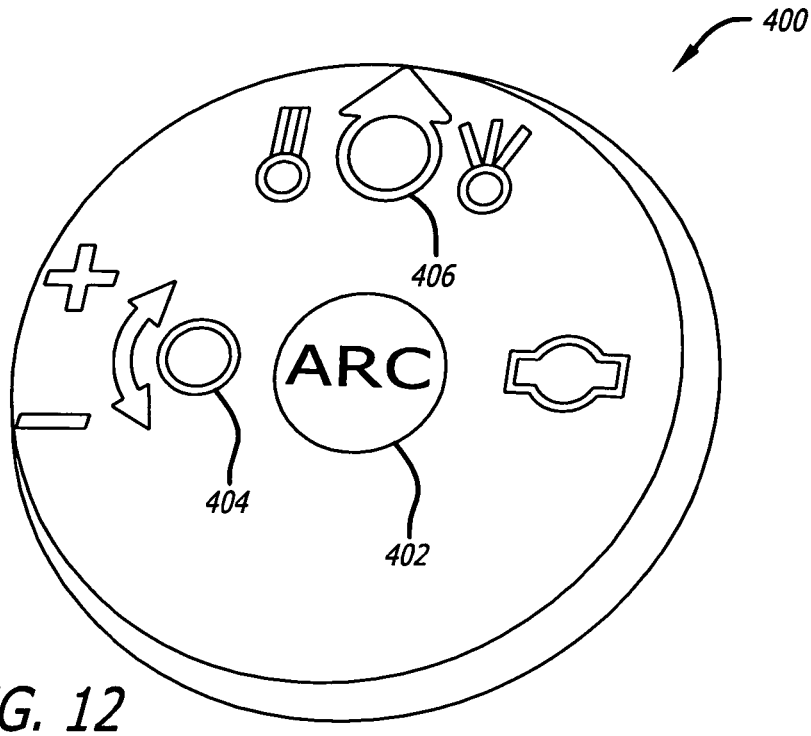
FIG. 12

ADJUSTABLE ARC SPRINKLER WITH FULL CIRCLE OPERATION

FIELD OF THE INVENTION

This invention relates generally to irrigation sprinklers rotatably driven through a complete or adjustably set partial circle path. More specifically, this invention relates to an irrigation sprinkler having an improved trip mechanism to allow for both a reversing part-circle mode and a non-reversing full-circle mode.

BACKGROUND OF THE INVENTION

Irrigation sprinklers are vital components to an irrigation system, spraying a stream of water over a desired area to irrigate lawns, gardens, or other terrain. While many irrigation sprinklers act in a superficially similar manner to distributing water from their nozzles, the internal designs of these sprinklers may vary widely in design.

One popular irrigation sprinkler design is the gear driven rotary sprinkler. This sprinkler design rotates to dispel water in various directions and is driven in rotation by the force of water passing by an internal turbine. The turbine drives a series of planetary gear stages, used for reducing the speed of the sprinkler rotation relative to the turbine. Further, additional mechanisms may be included for rotational reversing capabilities. Examples of different designs may be seen in U.S. Pat. Nos. 4,625,914; 5,330,103; and 5,662,545; all hereby incorporated by reference.

Previous adjustable arc rotary sprinkler designs allow a user to water varying areas in one mode only, namely a reversing circle mode, streaming water back and forth within a horizontal arc. Hence, in order to water a complete circle around the sprinkler, the user must set the arc watering limits to 360 degrees. At this setting the prior art sprinkler rotates in one direction until it hits an arc stop, then reverses direction until it hits the other arc stop.

This strategy for full circle watering in prior art models provides uneven water distribution because the sprinkler stops for an instant when reversing direction. Since the point of rotation reversal (i.e., the arc stop position) is approximately the same in each direction when watering a 360 degree arc, that reversal point receives significantly more water over time than the other points on the arc. Consequently, the watering pattern for the 360 degree, reverse direction type of sprinkler can lead to uneven grass growth or even damage to the lawn or vegetation.

What is desired is an adjustable arc rotary sprinkler that evenly distributes water when watering a full circle around the sprinkler.

OBJECTS AND SUMMARY OF THE INVENTION

It is an object of the present invention to provide an adjustable arc rotary sprinkler that evenly distributes water when set to a full circle mode.

It is a further object of the present invention to provide an adjustable arc rotary sprinkler that is easily adjusted to water varying arcs around the sprinkler.

These and other objects not specifically enumerated herein are addressed by the present invention by providing a sprinkler with both a reversing part-circle mode and a non-reversing full-circle mode. More specifically, the present invention provides a mechanism for disengaging sprinkler arc stops, allowing for a full circle, non-reversing watering pattern.

BRIEF DESCRIPTION OF THE DRAWINGS

FIG. 6 illustrates a side cut-away view of a stator according to the present invention;

FIG. 12 illustrates a top view of a sprinkler base cover according to the present invention;

DETAILED DESCRIPTION OF THE INVENTION

The present invention provides an improved rotary sprinkler design that rotates within an adjustable arc or non-reversing full circle rotation. As such, a user may optionally adjust the sprinkler of the current invention to reversibly rotate between two user-defined stops or adjust it to continuously and non reversibly rotate. By providing the additional functionality of continuous non reversible rotation, even water distribution is better ensured.

Sprinkler Head

Figure 1:
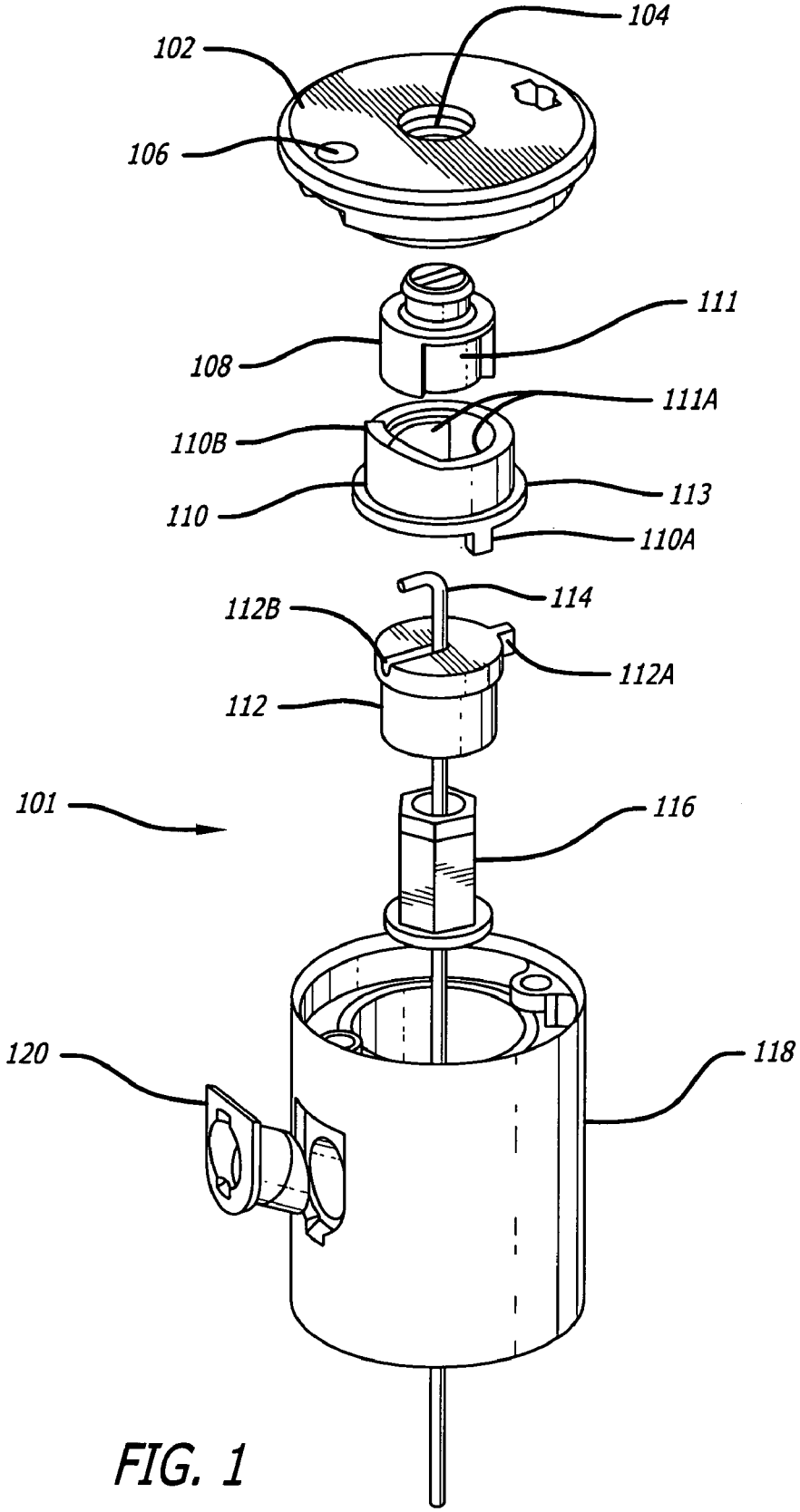
FIG. 1 illustrates a disassembled perspective view of a sprinkler head according to the present invention.
Figure 2:
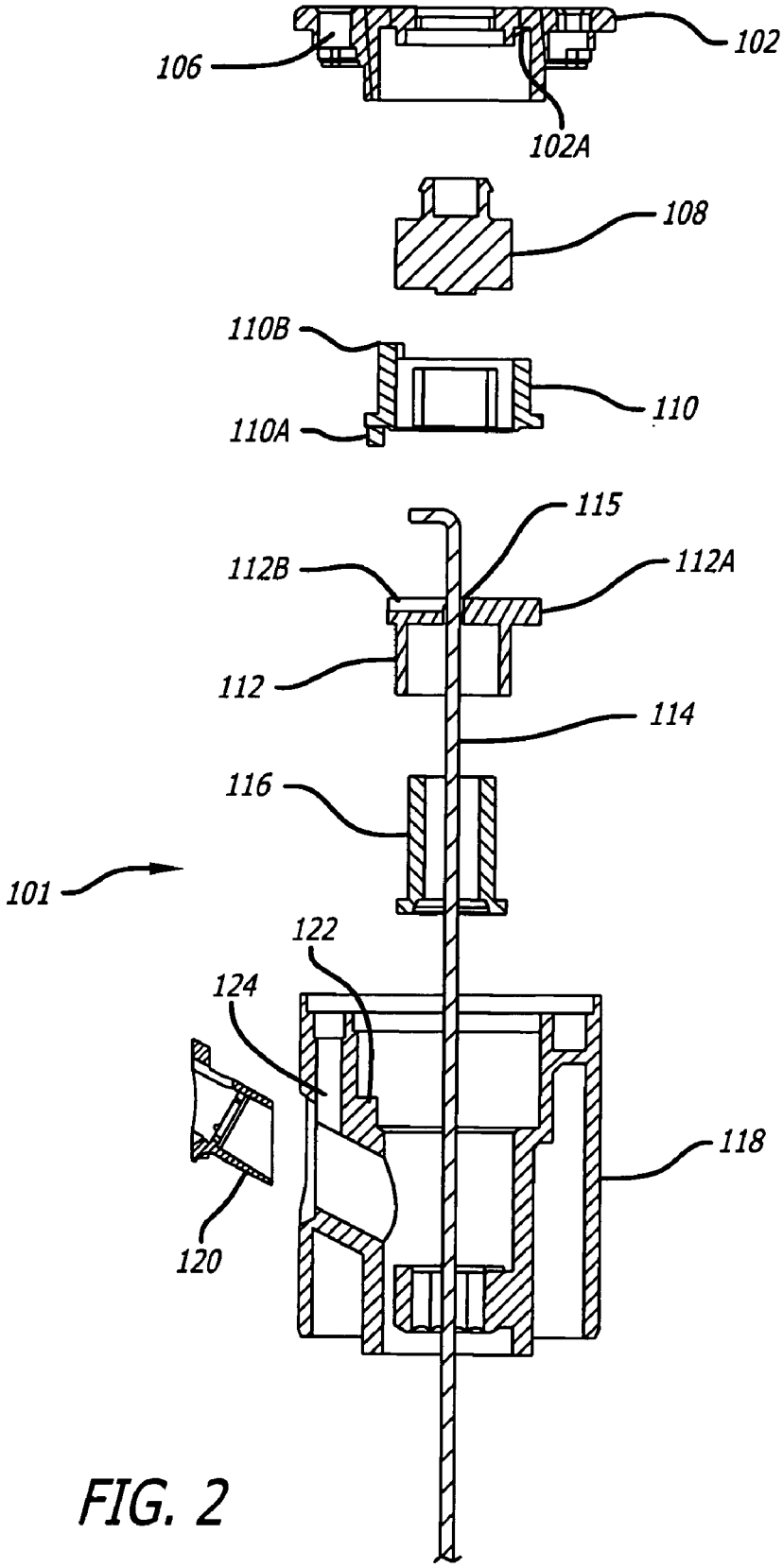
FIG. 2 illustrates a disassembled side cut-away view of the sprinkler head of FIG. 1.

Looking first to FIGS. 1 and 2, a preferred embodiment of a sprinkler head 101 is illustrated according to the present invention. The main structure of sprinkler head 101 is formed by nozzle base 118. Nozzle base 118 functions as a protective enclosure for the components of sprinkler head 101, as well as to secure the internal components into their proper positions.

As is the case with this embodiment, the nozzle base 118 is typically cylindrical in shape, having a side aperture for nozzle 120 angled outward for distribution of water. Like most of the components of improved sprinkler 100, nozzle base 118 is composed of a light-weight but durable plastic, allowing it to withstand the elemental wear associated with outdoor equipment.

Referring to FIGS. 1–5, within nozzle base 118 are several distinct components that set or bypass the arcuate watering pattern. Arc adjuster 110 and nozzle base 118 provide the physical arc stops 110*a*, 122 that cause the sprinkler head to reverse rotation within a desired arc. When either of the stops 110*a*, 122 rotate into contact with a fixed stop 112*a* on the arc trigger 112, the trip shaft 114 is rotated slightly, causing a flow director 148 to reverse the rotation of the sprinkler head 101. In a preferred embodiment, this trip shaft 114 may be disengaged from the arc trigger 112, allowing the sprinkler head 101 to rotate continuously in a single direction. These components and their interactions are described in greater detail below.

The top-most component is the nozzle base cover 102 that is assembled into the top aperture of nozzle base 118. The nozzle base cover 102 functions to keep out dirt and elements from the inside of sprinkler 100 by sealing around the circumference of the nozzle base cover 102 and a lip that hangs over the nozzle base 118 aperture.

The nozzle base cover 102 has two adjustment apertures that allow a user to access adjustment mechanisms below the cover 102. Breakup screw aperture 106 allows a user to adjust a breakup screw 124, best seen in FIG. 2, to move into the water path within nozzle 120. In this manner, the breakup screw 124 acts to breakup the water stream to varying degrees, depending on how far into the water stream the breakup screw 124 is adjusted. The ultimate effect of the breakup screw 124 is to breakup the out-going stream of water into a more scattered distribution of water, as opposed to the more narrowly projected water stream that would otherwise exit from the nozzle.

Arc adjustment aperture 104 allows a user to access a mechanism, described in detail below, for adjusting the rotational arc of the sprinkler. In this preferred embodiment, the arc adjustment aperture 104 is in the center of nozzle base cover 102, allowing a user to easily access the adjustment mechanism with a desired tool. However, the arc adjustment aperture 104 may be positioned at any point on the nozzle base cover 102 with the addition of translational gearing (not shown) within the sprinkler head 101 to compensate for the positional change.

Figure 10:
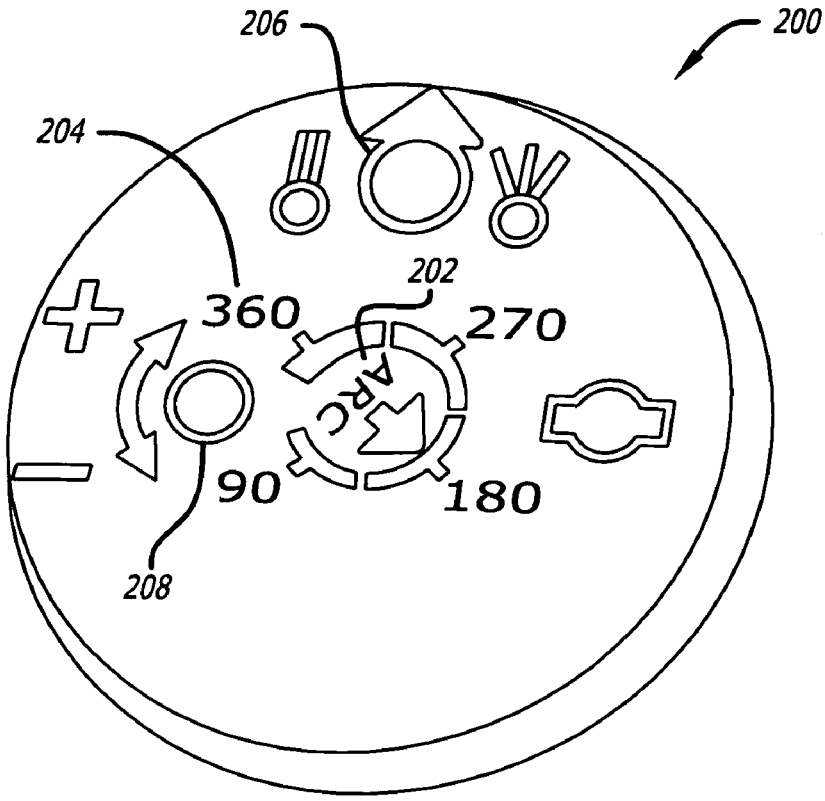
FIG. 10 illustrates a top view of a sprinkler base cover according to the present invention.
Figure 11:
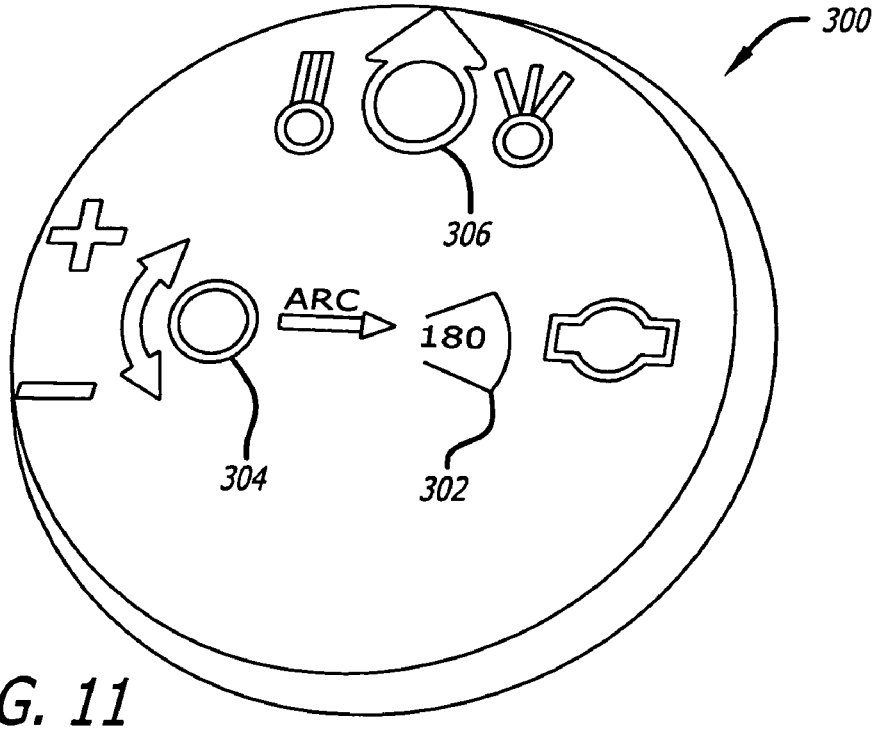
FIG. 11 illustrates a top view of a sprinkler base cover according to the present invention.

As seen in FIGS. 10–12, varying designs may be used for nozzle base cover 102, including different positioning of access holes such as breakup screw aperture 106, 206, 306, 406 or arc adjustment aperture 104, 204, 304, 404. Optionally, nozzle base cover 102 may include an arc display, communicating the size the arc is currently set to. These variations are described in greater detail below.

Referring to FIGS. 1–5, within the arc adjustment aperture 104 can be seen the top of arc adjuster center 108 that seals against the inside of nozzle base cover 102. Thus, elements and dirt are kept out of the sprinkler 100 by this seal between the nozzle base cover 102 and the arc adjuster center 108.

Primarily, the arc adjuster center 108 provides a point of interaction between the user's arc adjustment tool and the arc adjustment mechanism in the sprinkler 100. As seen in FIG. 1, the arc adjuster center 108 has a slotted engagement groove, allowing a user to rotate the arc adjuster center 108 with a tool such as a flat head screw driver, hence adjusting the arc of the sprinkler 100.

Arc adjuster center 108 is overall cylindrical in shape, having inwardly cut channels on the side of curved sides. The top portion having the slotted engagement groove for an adjustment tool is of a smaller diameter than the lower portion of the body. This smaller diameter of the arc adjuster center 108 matches the arc adjustment aperture 104 diameter, having an o-ring there between, allowing for a tight seal to keep dirt and other harmful particulate out of the sprinkler 100.

Figure 3:
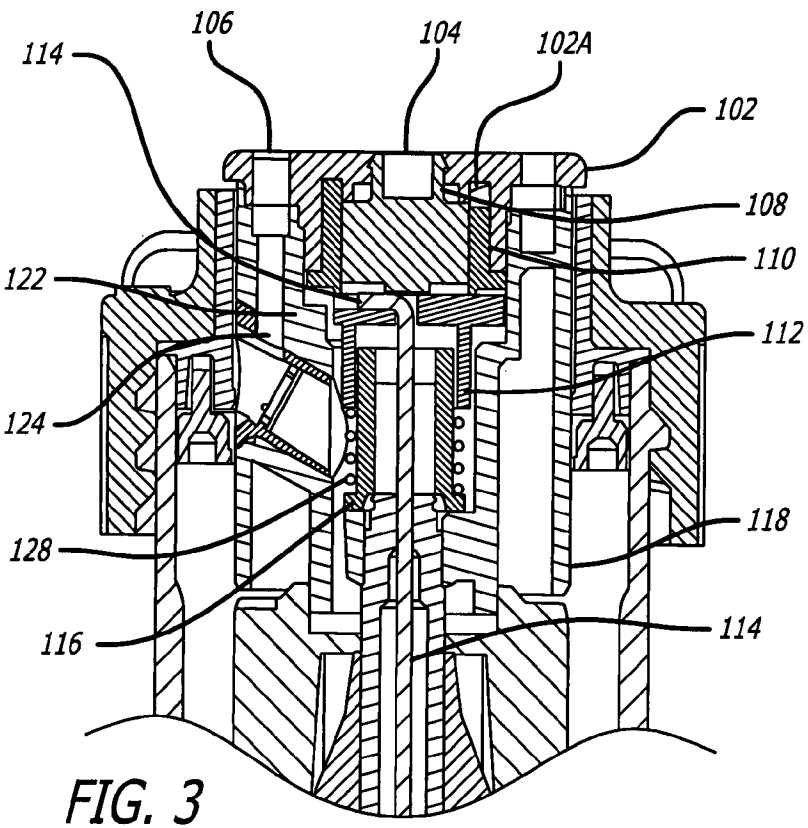
FIG. 3 illustrates a side cut-away view of the sprinkler head of FIG. 1 with the arc stops engaged.

The arc adjuster center 108 sits within arc adjuster 110, as best seen in FIGS. 1–3. The arc adjuster 110 provides a physical stop 110*a* within the arc adjustment mechanism, specifying when the sprinkler head should reverse rotation.

The arc adjuster 110 is also generally cylindrical in shape, having an inner diameter just large enough to allow arc adjuster center 108 to slide into it. The inner diameter of arc adjuster 110 has raised locking structures 111*a* designed to mate with the inwardly cut channels 111 of the arc adjuster center 108. A geared offset arc adjuster can also be used.

The arc adjuster 110 further possess a flange 113 extending outward from the lower portion of the cylinder. From that flange 113 extends an adjuster arm 110*a*, directed downward away from the nozzle base cover 102. As will be discussed later on, the adjuster arm 110*a* serves as an arc rotation stop which triggers the sprinkler to reverse direction of rotation at a set angle.

The top surface of arc adjuster 110 ramps upward at a small area of the top surface. Thus, a majority of the arc adjuster's 110 top surface is flat except for a small area of its circumference having the adjuster ramp 110*b*. The purpose of adjuster ramp 110*b* becomes clear when positioned against the underside of nozzle base cover 102. The underside of nozzle base cover 102 is shaped to accept and surround arc adjuster 110. Further, nozzle base cover 102 also has a small base cover ramp 102*a*, similar in shape and height to adjuster ramp 110*b*, but positioned on the lower surface of nozzle base cover 102 where the top surface of arc adjuster 110 normally touches.

In this fashion, the dual ramps 102*a*, 110*b* allow the arc adjuster 110 to evenly turn until the nozzle base ramp 102*a* and adjuster ramp 110*b* ramp meet each other. At their point of meeting, both ramps 102*a*, 110*b* act to push arc adjuster 110 downward. Turning arc adjuster 110 in the reverse direction moves the arc adjuster 110 upward into a position closer to the nozzle base cover 102. In this way, the dual ramps 102*a*, 110*b* allow the arc adjuster 110 to move upward and downward within the sprinkler head 101, the significance of which will become clear below.

Beneath the arc adjuster 110 sits arc trigger 112. Cylindrical in shape, arc trigger 110 has three main features: an arc stop 112*a*, a locking groove 112*b*, and a center shaft passage 115. The center shaft passage 115 and the locking groove 112*b* allow a trip shaft 114 to be positioned through the arc trigger 112 and lock into the locking groove 112*b*. Note that the trip shaft 114 should have an angled end, seen in FIG. 2, to best fit into locking groove 112*b*. When the trip shaft 114 is engaged in the locking groove 112*b*, the trip shaft 114 thereby holds the arc trigger 112 stationary relative to the remaining components that rotate with nozzle base 118.

The arc stop 112*a* extends radially outward from the top of arc trigger 112, yet is flush with the top surface of arc adjuster 110, allowing arc adjuster 110 to evenly sit on top of arc trigger 112. The total diameter of arc trigger 112 is slightly smaller than the flanged lip of arc adjuster 110. In this manner, arc adjuster 110 sits on top of arc trigger 112 and can be held stationary (by trip shaft 114) relative to the rotational movement of arc adjuster 110.

Figure 4:
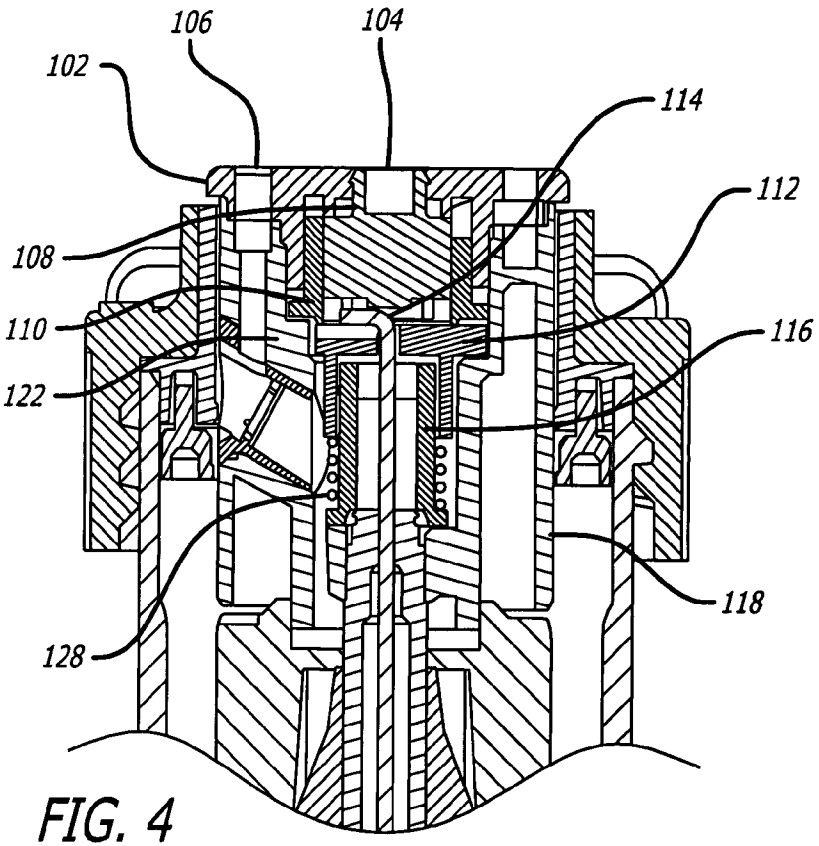
FIG. 4 illustrates a side cut-away view of the sprinkler head of FIG. 1 with the arc stops disengaged.
Figure 5:
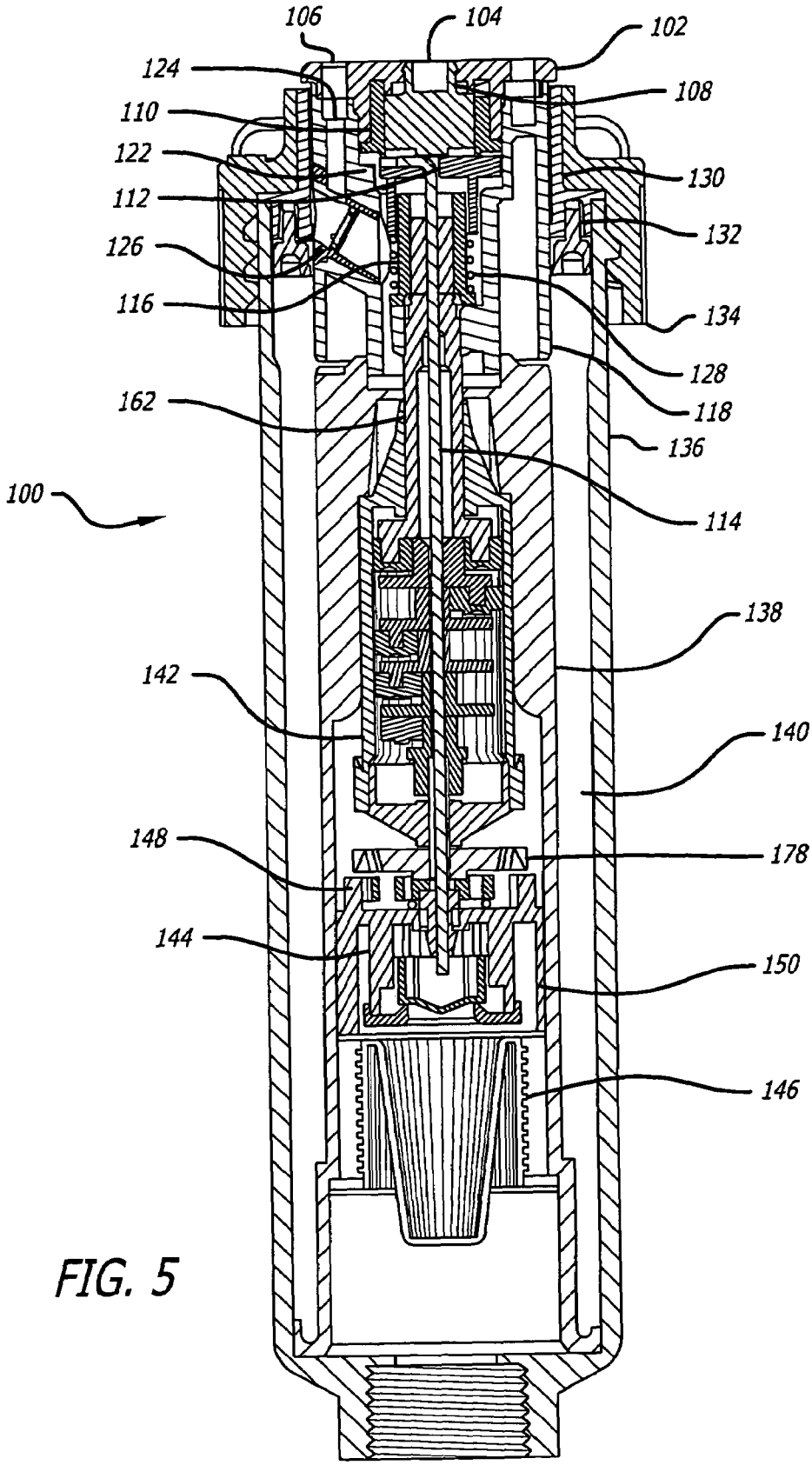
FIG. 5 illustrates a side cut-away view of a sprinkler according to the present invention.

The last prominent components of sprinkler head 101 are nozzle base nut 116 and trigger spring 128, best seen in FIGS. 3–5. The nozzle base nut 116 is hexagonal in shape, having screw threading on its inner surface, while sized to an overall diameter that allows the top of nozzle base nut 116 to sit within the bottom of arc trigger 112.

The combination of the nozzle base nut 116 and trip spring 128 act to bias arc trigger 112 upward against the height-fixed trip shaft 114, maintaining the locked position of the trip shaft 114 in the locking groove 112*b*. The bottom of nozzle base nut 116 has a flanged lip shaped to retain trigger spring 128, best seen in FIG. 3, allowing trigger spring 128 to sit on the nozzle base nut 116 lip. When assembled, the arc trigger 112 is positioned over nozzle base nut 116 while the bottom of arc trigger 112 contacts the top of trip spring 128, allowing the trip spring 128 to provide an upward biasing force.

In summary, the arc adjustment mechanisms of the sprinkler head can be best described as follows: The nozzle base nut 116 and trip spring 128 bias arc trigger 112 against trip shaft 114 in an engaged position, as shown in FIG. 3. This trip shaft 114 may be "tripped" by slight rotation caused by the rotation of stop 122 of the nozzle base or the rotation of arc stop 110*a* into the fixed stop 112*a* of the arc trigger 112, which, in turn, causes reversal of the sprinkler head 101 rotation. These stops may be disengaged by full rotation of the arc adjuster 110 which pushes arc trigger 112 downward, disengaging trigger shaft 114 as discussed below.

Riser Body

Figure 8:
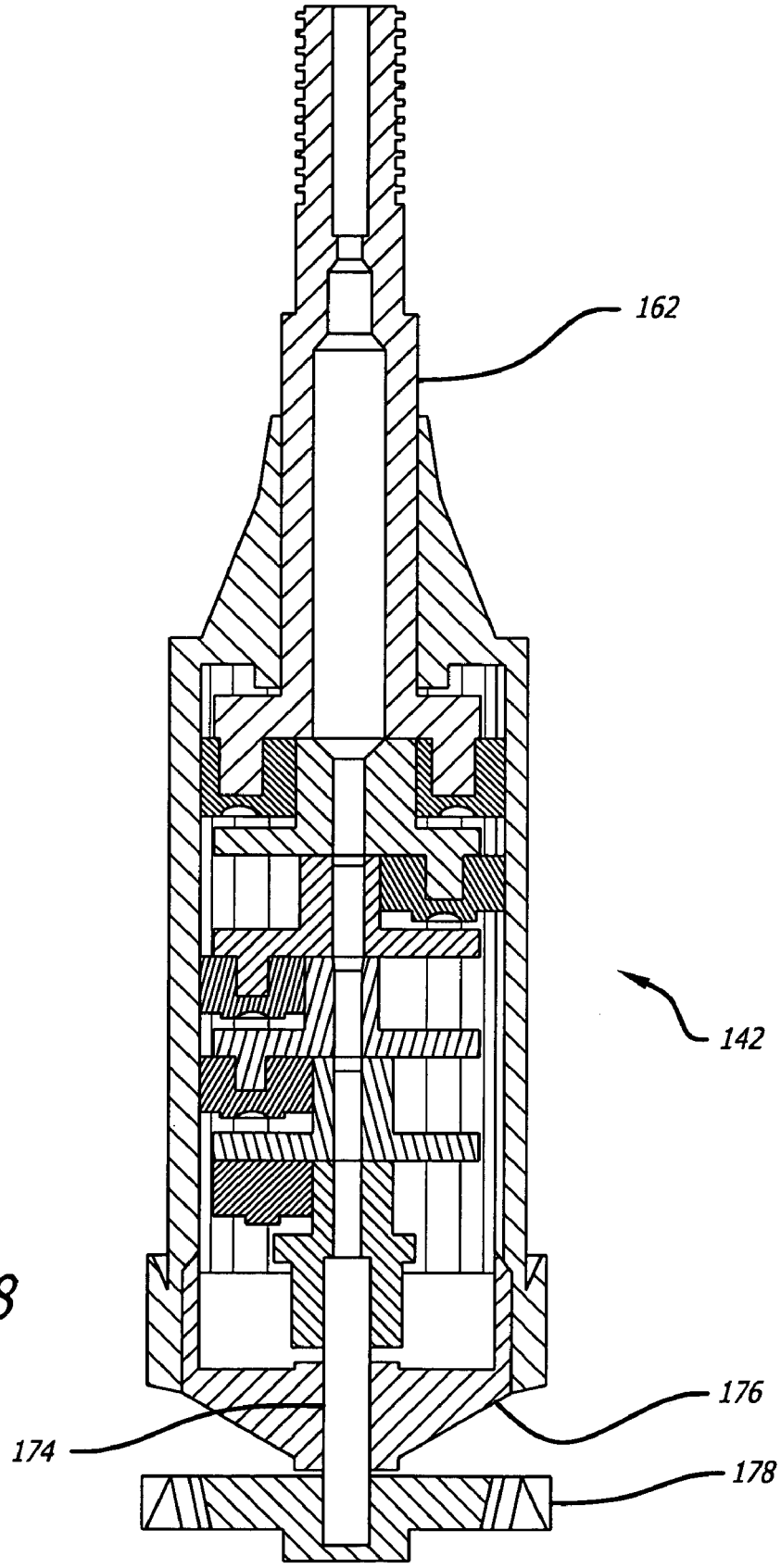
FIG. 8 illustrates a side cut-away view of a sprinkler drive assembly according to the present invention.
Figure 9:
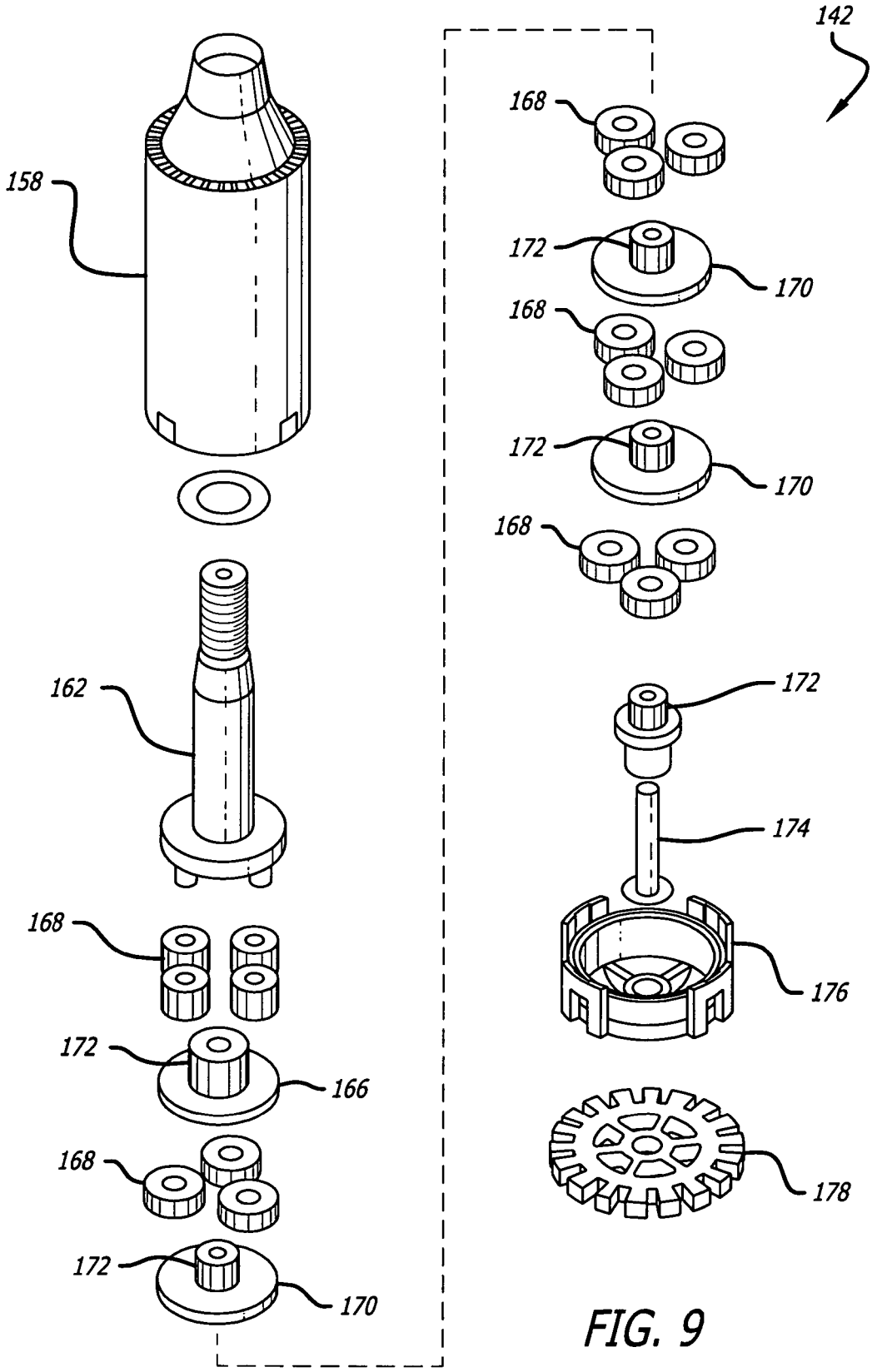
FIG. 9 illustrates a disassembled perspective view of the-sprinkler drive assembly of FIG. 8.

Turning now from the sprinkler head 101 to the main body of the riser assembly 138 is the drive assembly 142, best seen in FIGS. 5, 8, and 9. In many ways, this preferred embodiment illustrates a typical drive assembly, having multiple gear sets within the drive assembly 142 body driven by a turbine 178, and providing force to rotate the sprinkler head 101. An example of such a drive assembly 142 can be seen in U.S. Pat. No. 5,662,545, hereby incorporated by reference.

The force causing the sprinkler head 101 to rotate originates with the turbine 178, which rotates when water is pushed past it. The turbine 178 transmits this rotational force by way of a turbine shaft 174 fixed to the center of the turbine and passing through the end cap 176 of the drive assembly 142. From there, the rotational force is transmitted by a series of planetary gears 168 and sun gears 172 mounted to gear carriers 170.

Each level of gears 168 engages with both sun gears 172 and an internal ring gear (not shown) on the inside of drive housing 158. This internal ring gear is elongated along the axis of the drive housing 158 to extend for a distance which is sufficient to encompass the height of the stacked gear train, i.e. planetary gears 168, sun gears 172, and mounted gear carriers 170. Thus, as sun gears 172 rotate the planetary gears 168, the planetary gears 168 rotate or crawl around the ring gear.

The ring gear of the drive housing 158, in turn, transmits this rotational force to the output shaft 162. As best seen in FIG. 5, the output shaft 162 engages nozzle base 118, further screwing into the inner threads of nozzle base nut 116. In this fashion, the drive assembly is able to rotate the sprinkler head 101 when water is flowing to the turbine 178.

Stator Assembly

Figure 7:
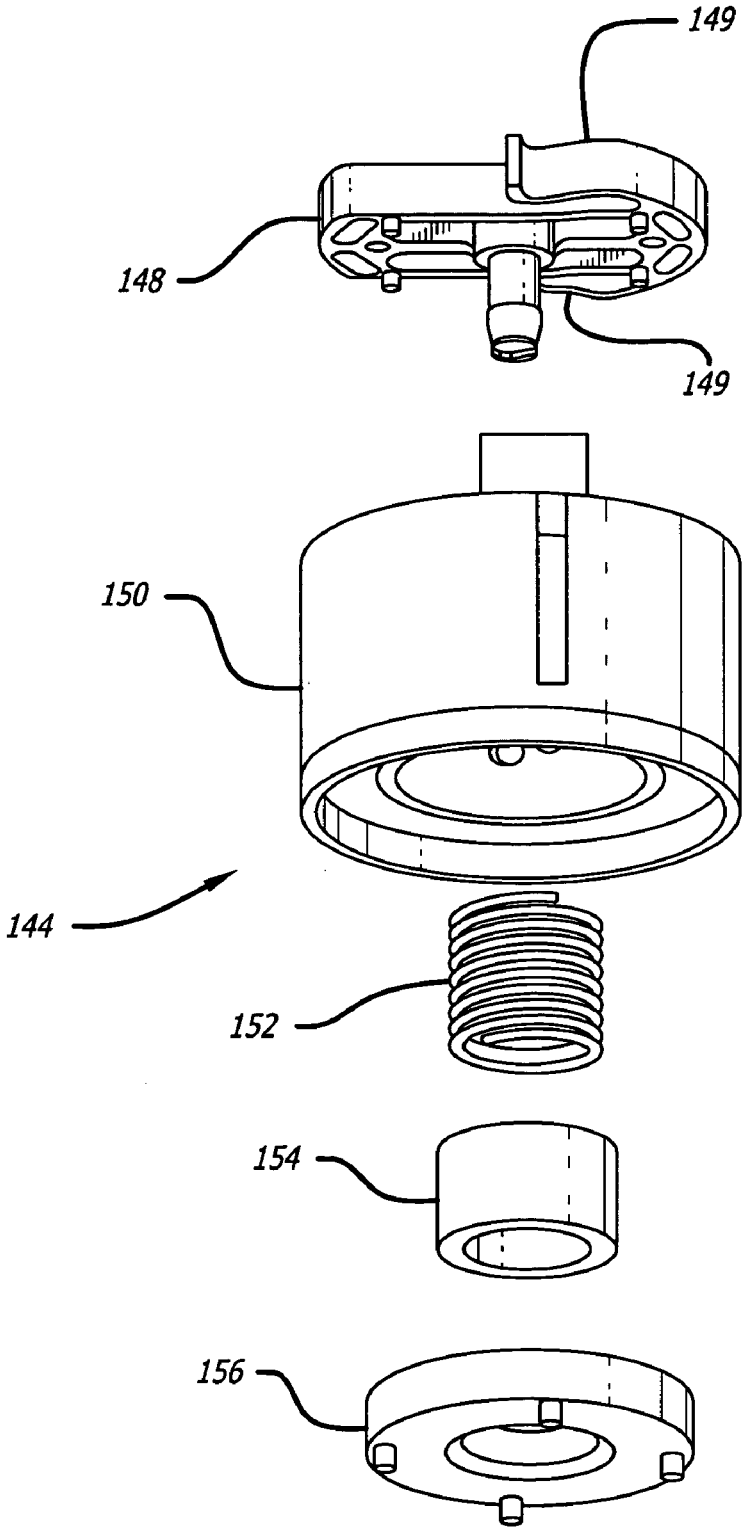
FIG. 7 illustrates a disassembled perspective view of the stator of FIG. 6.

The stator assembly 144 functions to redirect the flow of water against the previously mentioned turbine 178, switching turbine 178 rotation, and consequently sprinkler head 101 rotation, between a clock-wise and counter clock-wise direction. Best seen in FIGS. 5–7, the stator assembly 144 is positioned directly underneath turbine 178 and over screen 146.

The main structural component to stator assembly 144 is the stator housing 150, containing the flow director 148, the stator spring 152, the stator plunger 154, and the stator retainer 156. Structurally, the flow director 148 engages the top side of stator housing 150 by way of a center aperture which accepts the central shaft structure of the flow director 148.

The stator assembly 144 regulates the water passing through it by way of a spring valve created by stator spring 152 and stator plunger 154. Both components are located within the stator housing 144, held within by stator retainer 156. Thus, when water pressure increases, the stator plunger 154 is pushed back against the bias of stator spring 152, allowing water to bypass the flow director 148 to ensure uniform speed of rotation.

The flow director 148 rotates between one of two positions, due to the molded arms 149 on the flow director 148 that act as an over-center spring. These arms 149 ensure that the flow director 148 is snapped into either position at all times. Since each of these two flow director 148 positions allow water to pass to the turbine 178 to cause different directions of turbine 178 rotation, the sprinkler head 101 will rotate as long as water pressure is present.

The flow director 148 is directed to each of the two flow positions by trip shaft 114 which passes from the sprinkler head, down through the center of drive assembly 142 and is secured to the center of flow director 148. This design allows a slight rotation of the trip shaft 114 to move the flow director 148 to its alternate position, changing the direction of water flow against the turbine 178 and consequently selectively reversing rotational direction of the sprinkler head 101.

Sprinkler Operation

As previously mentioned, the sprinkler 100 operates in two water distribution modes, reversing part-circle mode and non-reversing full-circle mode. The operation of both modes are subsequently described below.

Turning first to the part-circle mode of the present invention, a user begins by setting arc limits within which the sprinkler will water. This is accomplished by using an arc adjustment tool to turn the arc adjuster center 108 which also rotates the arc adjuster 110. The purpose for this rotation is essentially to position the arc stop 110*a* in a position to trip the rotation reversal mechanism.

Next, the user turns on the water supply for the sprinkler, setting the sprinkler 100 in motion. As the water enters the sprinkler 100, the riser body 140 "pops-up" from the ground. The water passes through screen 146 and into the stator assembly 144. From there, the flow director 148 directs the water flow towards the turbine 178, causing the turbine 178 to rotate and drive the gears of the drive assembly 142.

With the drive assembly 142 in motion, the output shaft 162 rotates the nozzle base 118 and consequently the sprinkler head 101. However, the arc trigger 112 does not rotate with the sprinkler head 101, instead remaining stationary with the trip shaft 114.

As the nozzle base 118 rotates, either the stop 122 of the nozzle base 118 or the stop 110*a* of the arc adjuster (depending on the initial direction of rotation) rotates until it contacts fixed arc stop 112*a*. Once either of these stops contact the fixed stop 112*a*, the arc trigger 112 is rotated slightly and thereby rotates the trip shaft 114 slightly (by virture of the locking groove 112*b*). Since the trip shaft 114 can store energy when rotated and is connected to the flow director 148, the slight rotation of the trip shaft 114 "snaps" flow director 148 into its alternate position, changing the water flow to rotate the turbine 178 in the alternate direction. Thus the sprinkler head 101 reverses rotational direction until the other of the stops 122 or 110*a* contact the fixed arc stop 112*a*. In this manner, the sprinkler 100 rotates back and forth between the two arc stops 122, 110*a* to water a desired area.

Turning now to the non-reversing full circle mode, the user simply rotates the arc adjuster center 108 completely in one direction. This action acts to disengage the trip shaft 114 from the locking groove 112*b* of arc trigger 112, as best seen in FIG. 4.

The trip shaft 114 disengages due to the adjuster ramp 110*b* on arc adjuster 110 and the base cover ramp 102*a* on the bottom side of nozzle base cover 102. During reversible part-circle mode, the two ramps 102*a* and 110*b* do not engage each other. However, when the arc adjuster center 108 is rotated completely, the arc adjuster 110 also rotates, engaging the two ramps 102*a*, 110*b* .

As the ramps 102*a*, 110*b* engage, they cause the arc adjuster 110 to move downward, applying downward pressure to the arc trigger 112, thus moving the arc trigger 112 downwards against the bias of trigger spring 128. The trigger shaft 114 remains at its fixed height, and so becomes disengaged from the locking groove 112*b*.

With the trigger shaft 114 disengaged, the flow director 148 will not be switched into its alternate flow directing position, and so the sprinkler 100 will continue rotating in one direction. As the sprinkler head 101 rotates, the stop 122 or the stop 110 (depending on the direction of rotation) merely pushes stop 112*a* instead of causing a change in rotational direction. Since both ramps 102*a* and 110*b* are engaged and the trigger shaft 114 is not engaged, the arc trigger 112, is no longer held in a fixed rotational position, allowing it to rotate along with nozzle base 118.

To return to the reversing part-circle mode, the user merely rotates the arc adjuster center 108 to a desired arc setting.

Visual Arc Adjust

As previously mentioned, FIGS. 10–12 illustrate alternative preferred embodiments of the nozzle base cap. Specifically, these preferred embodiments focus on providing visual indicia for indicating the arc adjustment.

Turning to FIG. 10, the nozzle base cover 200 includes a breakup screw aperture 206, an arc adjust aperture 208, arc scale 204, and arc indicator 202. The arc indicator 202 is coupled to the arc adjustment mechanism of the sprinkler, preferably by a series of gears (not shown), to indicate the current arc size by pointing to the arc scale 204. As the user adjusts the arc through arc adjust aperture 208, the arc indicator 202 rotates accordingly to display this adjustment. Thus, a user is able to easily visually determine the current size of the sprinkler's arc adjustment.

FIG. 11 illustrates another preferred embodiment of the nozzle base cover 300, including breakup screw aperture 306, arc adjust aperture 304, and arc display window 302. As with the previous embodiment, arc display window 302 is coupled to the arc adjustment mechanism of the sprinkler, preferably by a series of gears (not shown), to indicate the current arc size by showing an arc number. As the user adjusts the arc through arc adjust aperture 208, the arc display window 302 displays the correct arc setting by rotating a disk beneath nozzle base cover 300 having selected arc angle numbers printed on it. In this fashion, different arc numbers are displayed according to how the user adjusts the arc.

FIG. 12 illustrates yet another preferred embodiment of the nozzle base cover 400, including breakup aperture 406, arc adjust aperture 404, and arc display 402. This preferred embodiment functions in a similar fashion to previous embodiments, in that it visually displays the sprinkler's rotation arc on the top of the nozzle base cover. The arc display 402 communicates arc size by uncovering varying amounts of a hidden circle within the arc display 402. This uncovering mechanism is mechanically coupled to the arc adjuster of the sprinkler. As the user adjusts the sprinkler arc setting by way of arc adjust aperture 404, the circle of arc display 402 becomes uncovered by a proportional amount. Thus, the size of the sprinkler arc is communicated to the user.

Figure 13:
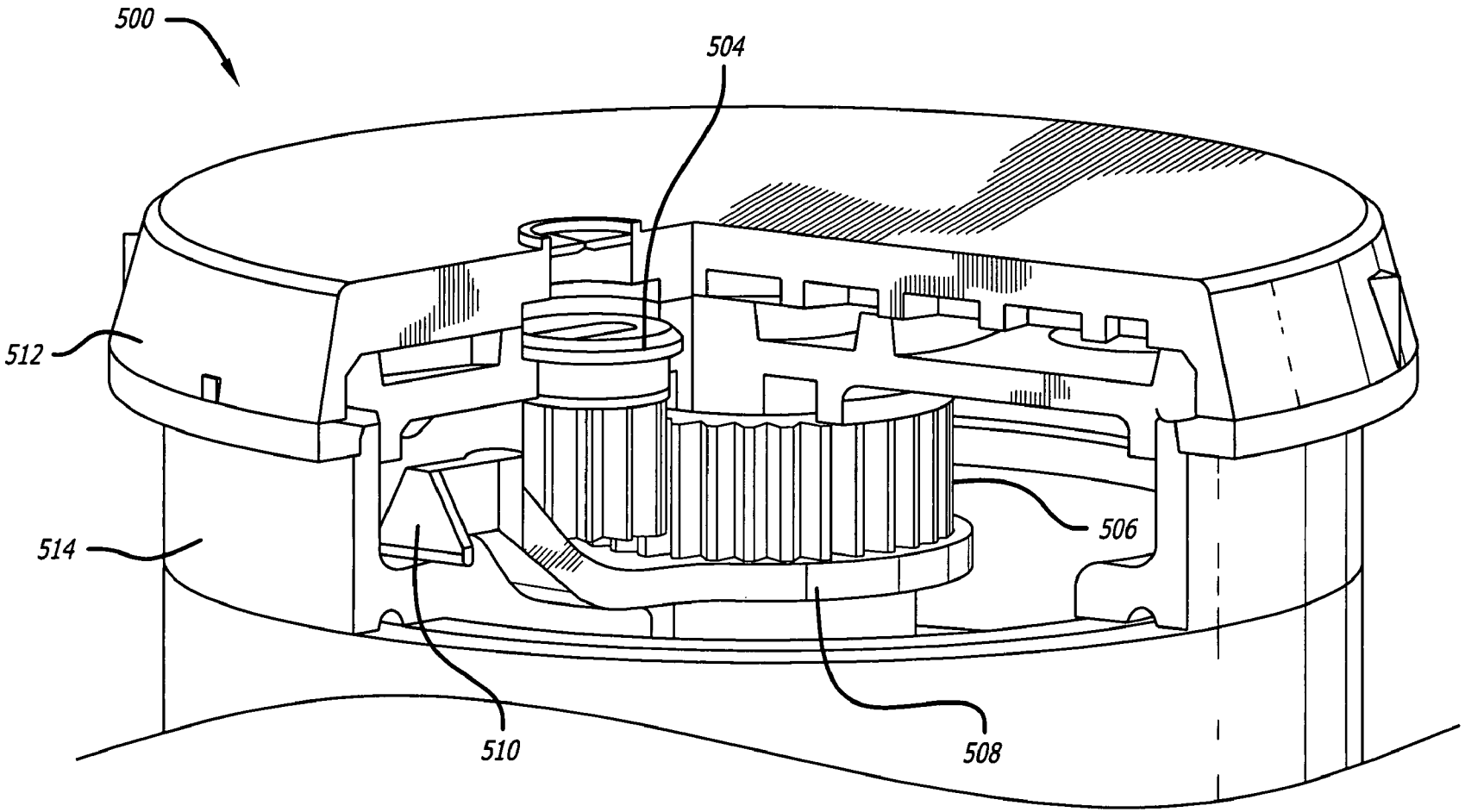
FIG. 13 illustrates a side perspective view of a sprinkler base with a side arc indicator according to the present invention.

FIG. 13 illustrates another preferred embodiment of a side view arc indicator 500 which allows a user to view the arc watering angle by looking through a transparent side window 514 in the sprinkler body to view the position of an arc indicator 510. Arc angle indicia 512 are positioned above the transparent side window 514, allowing a user to line up the arc indicator 510 with the indicia 512 and gauge the current arc watering angle that the sprinkler is currently set to. In operation, the user rotates the geared arc adjuster 504 which is coupled to an adjacent gear 506 that also rotates. A moveable stop 508 is coupled to the adjacent gear 506, allowing the moveable stop 508 and the connected arc indicator 510 to rotate along with the adjacent gear 506. In this manner, as the arc adjuster 504 is rotated, the arc indicator 510 moves within the transparent side window 514, underneath the arc indicia 512, visually communicating the current arc size to the user.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A rotary sprinkler comprising:

a sprinkler housing adapted for connection to a supply of irrigation water;

a spray head for outward projection of an irrigation water stream and supported for rotation relative to said housing;

a rotary drive assembly for rotatably driving said spray head;

a reversing mechanism for reversing the direction of said spray head rotation; and a disengagement mechanism for disengaging said reversing mechanism, said disengagement mechanism comprising a biased member shaped and sized to engage a trip shaft of said reversing mechanism and disengage said trip shaft when depressed;

wherein said biased member includes: a locking groove shaped to secure said trip shaft for rotation; and a biasing spring positioned to bias said locking groove against said trip shaft.

2. The rotary sprinkler of claim 1 wherein said biased member includes an adjustable arc stop.

3. The rotary sprinkler of claim 1 wherein rotation of said trip shaft reverses direction of said spray head rotation.

4. The rotary sprinkler of claim 1 further comprising an adjustable arc stop coupled to said biased member, said adjustable arc stop sized and shaped to rotate said biased member when engaged, further causing said trip shaft to change direction of said reversing mechanism.

5. A rotary drive sprinkler comprising:

a sprinkler housing adapted for connection to a supply of water;

a spray head for outward projection of an irrigation water stream and supported for rotation relative to said housing;

a water driven gear drive transmission for rotatably driving said spray head to sweep said irrigation water over surrounding terrain; and a reverse assembly including a shift mechanism movable between forward and reverse drive positions for respectively shifting said gear drive transmission between forward and reverse drive rotation directions for correspondingly reversing the direction of rotatable driving of said spray head, said reverse mechanism being operable by way of a trip shaft; and a disengagement mechanism for disengaging said reversing mechanism, said disengagement mechanism comprising a biased member shaped and sized to disengage said trip shaft of said reversing mechanism when said biased member is depressed;

wherein said biased member includes: a locking groove shaped to secure said trip shaft for rotation; and a biasing spring positioned to bias said locking groove against said trip shaft.

6. The rotary sprinkler of claim 5 wherein said biased member includes an adjustable arc stop.

7. The rotary sprinkler of claim 5 wherein rotation of said trip shaft reverses direction of said spray head rotation.

8. The rotary sprinkler of claim 5 further comprising an adjustable arc stop coupled to said biased member, said adjustable arc stop sized and shaped to rotate said biased member when engaged, further causing said trip shaft to change direction of said reversing mechanism.

9. The rotary sprinkler of claim 5 further comprising:

a nozzle base cap fixed to the top of said sprinkler housing, said nozzle base cap having a set of indicia on a top of said nozzle base cap for displaying an arc setting of said reverse assembly; and an indicating disk, rotatably mounted within said nozzle base cap and mechanically coupled to said reverse assembly so as to point to said indicia.

10. The rotary sprinkler of claim 5 further comprising:

a nozzle base cap fixed to the top of said sprinkler housing, said nozzle base cap having a window displaying an arc setting of said reverse assembly.

11. The rotary sprinkler of claim 5 further comprising:

a nozzle base cap fixed to the top of said sprinkler housing, said nozzle base cap having an arc indicator coupled to said reverse assembly, said arc indicator sized and shaped to uncover a portion of an indicator circle.

12. The rotary sprinkler of claim 5 further comprising:

an arc indicator coupled to said reverse assembly, said arc indicator configured to move within said sprinkler housing and be visible from an arc indicator window within said sprinkler housing, said sprinkler housing having arc indicia.

13. The rotary sprinkler of claim 5 further comprising:

a window within a sidewall of said sprinkler housing, said window displaying an arc indicator within said sprinkler housing.

* * * * *